United States Patent [19]

Nakazawa

[11] Patent Number: 4,600,668

[45] Date of Patent: Jul. 15, 1986

[54] ELECTROPHOTOGRAPHIC PROCESS

[75] Inventor: Toru Nakazawa, Osaka, Japan

[73] Assignee: Mita Industrial Co., Ltd., Osaka, Japan

[21] Appl. No.: 738,981

[22] Filed: May 29, 1985

[30] Foreign Application Priority Data

May, 1984 [JP] Japan ..... 59-109576

[51] Int. Cl.[4] ..... G03G 13/02

[52] U.S. Cl. ..... 430/31; 355/3 CH; 430/126; 430/125

[58] Field of Search ..... 430/31, 125, 126; 355/3 CH

[56] References Cited

U.S. PATENT DOCUMENTS 3,944,332 3/1976 Tutihasi ..... 350/342

*Primary Examiner*—John D. Welsh

*Attorney, Agent, or Firm*—Sherman and Shalloway

[57] ABSTRACT

In the electrophotographic process in which an image is formed by performing imagewise light exposure, toner development, toner image transfer and cleaning after charging a photoconductive photosensitive layer by direct current corona discharge, an organic photoconductive photosensitive layer in which the surface potential is saturated at 500 to 700 volts as the absolute value is used as the photosensitive layer and charging is carried out at an injection current which becomes saturated at said surface potential.

According to this process, good images can be stably obtained irrespectively of environmental changes or even if the cycle number of the copying operation is increased.

5 Claims, 3 Drawing Figures

ELECTROPHOTOGRAPHIC PROCESS

BACKGROUND OF THE INVENTION (1) Field of the Invention

The present invention relates to an electrophotographic process using an organic photoconductive photosensitive layer. More particularly, the present invention relates to an electrophotographic process in which the surface potential of a photosensitive layer is always stable irrespectively of the environmental change or the copying cycle number and a stable image is always formed.

(2) Description of the Prior Art

In a commercial electrophotographic copying operation, there is ordinarily adopted a system in which after charging a photosensitive layer by direct current corona discharge, operations of imagewise light exposure, toner development, toner image transfer and cleaning are repeated the necessary number of times.

The relation between the injection current value from a corona charger and the surface potential of a photosensitive layer at the charging step is ordinarily such that under certain conditions, the surface potential is monotonously increased with increase of the injection current. However, the injection current of the corona charger is greatly changed by environmental changes such as a change of the power source voltage and a change of the distance between the charger and the photosensitive layer, and by this change of the injection current, the surface potential of the photosensitive layer is changed. This tendency is conspicuous in an organic photoconductive photosensitive layer, in which injection of charges is not so easy as in a selenium type photosensitive plate, and the image quality is changed by the change of the surface potential owing to environmental changes in the organic photoconductive photosensitive layer.

When the copying operation is carried out repeatedly many times on an organic photoconductive photosensitive layer, the image density of prints is reduced with increase of the cycle number. Although the reason of this undesirable phenomenon is indefinite, it is considered that a carrier having a relatively long life is formed in the organic photoconductive photosensitive layer and injection of charges on the surface is rendered difficult by the space charge-controlling action of this carrier.

SUMMARY OF THE INVENTION

It is therefore a primary object of the present invention to provide an electrophotographic process using an organic photoconductive photosensitive layer, in which the surface potential given by corona discharge can be controlled to a certain level irrespectively of the environmental change or the copying cycle number.

More specifically, in accordance with the present invention, there is provided an electrophotographic process in which an image is formed by performing imagewise light exposure, toner development, toner image transfer and cleaning after charging a photoconductive photosensitive layer by direct current corona discharge, said process being characterized in that an organic photoconductive photosensitive layer in which the surface potential is saturated at 500 to 700 volts as the absolute value is used as the photosensitive layer and charging is carried out at an injection current which becomes saturated at said surface potential.

DETAILED DESCRIPTION OF THE PREFERRED EMBODIMENTS

The present invention will now be described in detail with reference to embodiments illustrated in the accompanying drawings.

Figure 1:
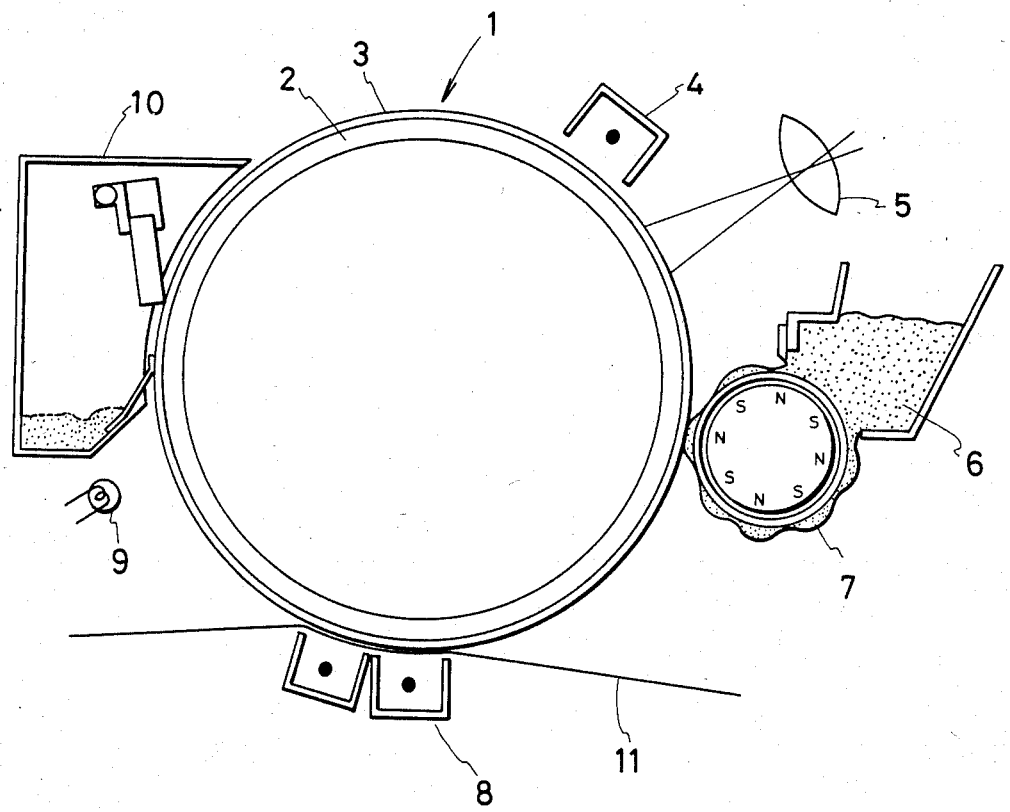
FIG. 1 is a diagram illustrating the steps of the electrophotographic process.

Referring to FIG. 1 illustrating the steps of the electrophotographic process, an organic photoconductive photosensitive layer 3 is formed on the surface of an electroconductive substrate 2 of a driving rotary drum 1.

A charging direct current corona charger 4, an optical system 5 for the imagewise light exposure, a developing mechanism 7 holding a toner 6 therein, a corona charger 8 for the toner image transfer, a light source 9 for removing the electricity and a toner cleaning mechanism 10 are arranged in this order along the surface of the drum 1.

At the start of the copying operation, the light source 9 for removing the electricity and the toner cleaning mechanism 10 are actuated to remove the residual toner, dusts and solids adhering to the surface of the photosensitive layer 3.

Then, the photosensitive layer 3 is charged with a certain polarity by the charging corona charger 4 and the imagewise light exposure is carried out through the optical system 5 to form an electrostatic image corresponding to an image of an original. A toner image is formed on the photosensitive layer 3 by the developing mechanism 7 by using the toner 6 charged with a polarity reverse to the polarity of the electrostatic image.

A copying paper 11 is supplied to this toner image-bearing surface of the photosensitive layer 3, and charging is effected with the same polarity as that of the electrostatic image from the back surface of the copying paper 11 by the transfer corona charger 8, whereby the toner image is transferred onto the surface of the copying paper 11. The copying paper 11 having the toner image transferred thereon is peeled from the photosensitive layer 3 and fed to a fixing mechanism (not shown) to form a print having the toner image fixed thereon.

In the photosensitive layer after transfer of the toner image, there is left the toner in a certain amount corresponding to the transfer efficiency. The particles of this residual toner are still charged in a quantity corresponding to the frictional charging tendency. In order to remove this residual charge, the entire surface of the photosensitive layer 3 is exposed to light by the light source 9 for removing the electricity. In this state where the Coulomb force between the toner and photosensitive layer is thus weakened, cleaning of the toner is performed by the cleaning mechanism 10, and then, the operations of from the main charging to the cleaning are repeated and several prints are obtained, whereby one reproduction process is completed. At subsequent reproduction cycles, after the above-mentioned cleaning operation, the main charging and subsequent operations are carried out.

In the instant specification and appended claims, by the term "injection current at the time of charging by the corona charger" is meant the actually measured value of the current flowing from the charger to the surface of a metal which is located instead of the photosensitive layer.

The present invention is characterized in that as the photosensitive layer 3, there is used an organic photoconductive photosensitive layer in which the surface potential is saturated at 500 to 700 volts, especially at 550 to 650 volts, as the absolute value, and charging by the corona charger 4 is carried out at an injection current which becomes saturated at said potential.

Figure 2:
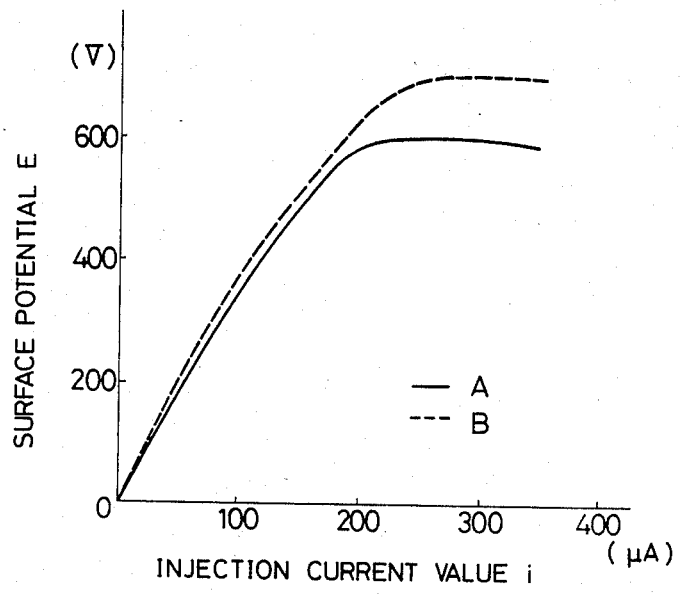
FIG. 2 is a diagram illustrating the relation between the injection current value (i) and the surface potential (E).

FIG. 2 illustrates the relation between the injection current value (i) and the surface potential (E) in the organic photoconductive photosensitive layer used in the present invention. From FIG. 2, it is seen that if the injection current from the charger is increased, the surface potential (absolute value) of the photosensitive layer is increased substantially proportionally to the increase of the current value at the initial stage, but in the photosensitive layer used in the present invention, the surface potential is saturated at a certain value Es within a range of 500 to 700 volts if the current value exceeds a certain level.

In the present invention, by carrying out the charging of the organic photoconductive photosensitive layer having the above-mentioned charging characteristics at an injection current value corresponding to the above-mentioned saturated surface potential Es, even if the injection current value is changed by the above-mentioned change of the power source voltage or clearance, the charging can always be performed at a certain surface potential. Namely, in the present invention, by using such a combination of the organic photoconductive photosensitive layer and the charging operation that an excessive injection current is supplied to the photosensitive layer, the variation of the surface potential are prevented.

Furthermore, according to the present invention, by using the above-mentioned combination of the photosensitive layer and the charging operation, even if the copying cycle is repeated to obtain many prints, an effect of preventing the reduction of the surface potential is unexpectedly attained.

In an organic photoconductive photosensitive layer, as pointed out hereinbefore, a carrier having a longer life time is more readily formed by charging or light exposure than in an inorganic photoconductor, and the surface charge is gradually controlled to a low level by the space charge-controlling action of this carrier.

For example, in case of a composite photosensitive layer comprising a charge-generating layer of a perylene type pigment and a charge-transporting layer of polyvinyl carbazole, even if the surface potential is 600 volts at the first cycle, the surface potential is reduced to about 500 volts at the 100th cycle. In contrast, according to the present invention, by using the above-mentioned combination of the photosensitive layer and the charging operation, the surface potential at the 100th cycle can be maintained substantially at the same level as at the first cycle. Although the reason has not been completely elucidated, it is considered that an electric current flowing excessively in the photosensitive layer will be effective for erasing the carrier.

In the present invention, all of organic photoconductive photosensitive layers can be similarly used, but especially good effects are obtained when the present invention is applied to a single-layer type organic photosensitive layer comprising a dispersion of a charge-generating pigment in a charge-transporting substance, which is formed on an electroconductive substrate. As the charge-generating pigment, there can be mentioned photoconductive organic pigments such as a perylene pigment, a quinacridone pigment, a pyranthrone pigment, a phthalocyanine pigment, a disazo pigment and a trisazo pigment. The charge-generating pigment is used in the state dispersed in a charge-transporting substance, for example, a charge-transporting resin such as polyvinyl carbazole or a resin containing a low-molecule charge-transporting substance such as a hydrazone derivative or a pyrazoline derivative.

The saturated surface potential of the photosensitive layer can be set by various means. This saturated surface potential depends on the thickness of the photosensitive layer, and as the thickness of the photosensitive layer is reduced, the saturated surface potential is reduced and as the thickness is increased, the saturated surface potential is increased. Although the optimum thickness of the photosensitive layer varies according to the composition of the photosensitive layer, it is preferred that the thickness of the photosensitive layer be 8 to 18 $\mu$m, especially 10 to 15 $\mu$m. The saturated surface potential changes also according to the electric resistance of the resin binder in the photosensitive layer and the incorporation ratio of the charge-generating pigment or charge-transporting substance in the photosensitive layer.

In the present invention, the value Es is set within the range of 500 to 700 V by adjusting the above-mentioned parameters. If the value Es is smaller than 500 V, formation of an image having a high density is difficult, and if the value Es is larger than 700 V, the transfer of the toner becomes difficult and the gradation is degraded.

The injection current from the charger can be set at a desired level by known means. For example, since this injection current is substantially proportional to the applied voltage of the charger, the injection current can be set at a desired level by adjusting the applied voltage. If the distance between the corona wire and the photosensitive layer is increased, the injection current is reduced, and if this distance is shortened, the injection current is increased. Accordingly, the injection current can be set at a desired level by adjusting this distance. Moreover, if the distance between the corona wire and the shield is shortened, the injection current is reduced and if this distance is increased, the injection current is increased. Accordingly, the injection current can be set at a desired level also by adjusting this distance. It is preferred that the injection current value be set so that when the injection current is reduced by 25%, the reduction ratio of the surface potential is lower than 10%, especially lower than 5%.

The development can be accomplished by a magnetic brush development method using a two-component type developer comprising an electroscopic toner and a magnetic carrier or a one-component type developer comprising a magnetic toner. Of course, other development means may be adopted in the present invention.

The toner cleaning can be accomplished not only by a mechanical cleaning method using a fur brush or blade but also by an electromagnetic cleaning method utilizing a magnetic brush. In the latter case, the magnetic brush for the development can be used also for the cleaning operation and one copying cycle may be accomplished by two rotations.

The present invention will now be described in detail with reference to the following examples that by no means limit the scope of the invention.

| Preparation of Photosensitive Materials | |
|---|---|
| N,N'—di(3,5-dimethylphenyl)-perylene-3,4,9,10-tetracarboxylic acid di-imide | 12 parts by weight |
| poly-N—vinylcarbazole | 100 parts by weight |
| Polyester resin (Vylon 200 supplied by Toyo Boseki K.K.) | 10 parts by weight |
| tetrahydrofuran | 150 parts by weight |

The above ingredients were mixed, and the liquid mixture was dispersed in a ball mill for 24 hours. The dispersion was coated on an aluminum plate having a thickness of 80 μm by a wire bar and dried at 100° C. for 30 minutes.

Two photosensitive materials having dry film thicknesses of 12 μm and 14 μm, respectively, were thus prepared.

Measured of Characteristics of Photosensitive Materials

Each of the so-obtained two photosensitive materials was separately set at a commercially available PPC copying machine (Model DC-121 supplied by Mita Industrial Co., Ltd.), and the injection current (i) to the drum from the direct current corona charger for the charging operation was changed and the surface potential (E) was measured.

At this measurement, the developing zone was removed from the copying machine and a probe of the surface potential meter was set at the position where the developer was brought into contact with the photosensitive drum.

The measurement results are shown in FIG. 2 and Table 1. In FIG. 2, curve A shows the results obtained in case of the photosensitive material having a thickness of 12μ, and curve B shows the results obtained in case of the photosensitive material having a thickness of 14 μm.

TABLE 1

| Sample | Thickness (μm) | Saturated Surface Potential Es (V) | Injection Current Value is (μA) at Es |
|---|---|---|---|
| A | 12 | 600 | 200 |
| B | 14 | 700 | 250 |

EXAMPLE

The above-prepared photosensitive material having a thickness of 12 μm (curve A in FIG. 2) was set at the copying machine (DC-121), and from the characteristic graph of FIG. 2, the injection current value (i) to the drum from the direct current corona charger was set at 250 μA so as to adjust the surface potential to 600 V and the cycle of charging-light exposure was repeated 1000 times. The surface potential Vsp was measured.

Figure 3:
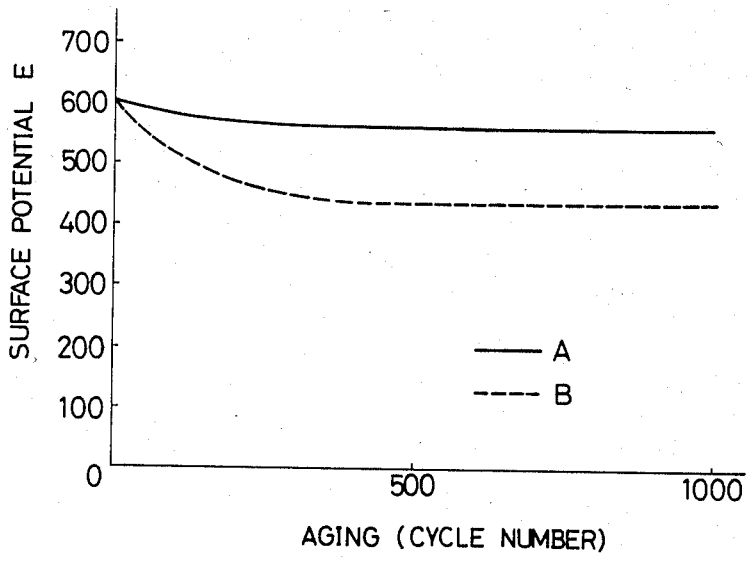
FIG. 3 is a diagram illustrating the relation between the surface potential (E) and the aging (cycle number).

The obtained results are shown in curve A in FIG. 3. It is seen that even at the 1000th cycle, the surface potential was not substantially reduced.

Then, the developing zone was attached to the copying machine and the copying test was carried out. Sharp and good images could be obtained from the first cycle, and no substantial change was caused at the 1000th cycle.

COMPARATIVE EXAMPLE

By using the photosensitive material having a thickness of 12 μm (curve B of FIG. 2), the injection current value was set at 190 μA so as to adjust the surface potential to 600 V, and the surface potential Vsp was measured in the same manner as described in the Example.

The obtained results are shown in curve B in FIG. 3. The surface potential was gradually reduced from the first cycle and the surface potential at the 1000th cycle was reduced by about 150 V from the level of the initial surface potential.

At the copying test, a good image was obtained at the first cycle, but the image density was gradually reduced with increase of the cycle number and the image quality was gradually degraded.

I claim:

1. An electrophotographic process in which an image is formed by performing imagewise light exposure, toner development, toner image transfer and cleaning after charging a photoconductive photosensitive layer by direct current corona discharge, said process being characterized in that an organic photoconductive photosensitive layer in which the surface potential is saturated at 500 to 700 volts as the absolute value is used as the photosensitive layer and charging is carried out at an injection current which becomes saturated at said surface potential.

2. An electrophotographic process according to claim 1, wherein the surface potential of the organic photoconductive photosensitive layer is saturated at 550 to 650 volts.

3. An electrophotographic process according to claim 1, wherein the organic photoconductive photosensitive layer is a layer composed of a dispersion of a charge-generating pigment in a charge-transporting resin or a binder resin containing therein a charge-transporting substance, which is formed on an electroconductive substrate.

4. An electrophotographic process according to claim 1, wherein the thickness of the organic photoconductive photosensitive layer is 8 to 18 μm.

5. An electrophotographic process according to claim 1, wherein the injection current is set so that when the injection current is reduced by 25%, the reduction ratio of the surface potential is lower than 10%.

* * * * *

UNITED STATES PATENT AND TRADEMARK OFFICE

CERTIFICATE OF CORRECTION

PATENT NO. : 4,600,668

DATED July 15, 1986

INVENTOR(S) : Toru Nakazawa

It is certified that error appears in the above-identified patent and that said Letters Patent is hereby corrected as shown below:

ON THE TITLE PAGE

[30] Foreign Application Priority Data delete "May, 1984",
insert --May 31, 1984--.

Signed and Sealed this

Seventh Day of October, 1986

[SEAL]

*Attest:*

DONALD J. QUIGG

*Attesting Officer*

*Commissioner of Patents and Trademarks*